US009255371B1

(12) United States Patent
Jordan

(10) Patent No.: US 9,255,371 B1
(45) Date of Patent: Feb. 9, 2016

(54) VEHICLE PULLED SNOW SCRAPER SYSTEMS

(71) Applicant: Joshua Jordan, Brooklyn, NY (US)

(72) Inventor: Joshua Jordan, Brooklyn, NY (US)

( * ) Notice: Subject to any disclaimer, the term of this patent is extended or adjusted under 35 U.S.C. 154(b) by 93 days.

(21) Appl. No.: 14/312,691

(22) Filed: Jun. 24, 2014

Related U.S. Application Data

(60) Provisional application No. 61/841,889, filed on Jul. 1, 2013.

(51) Int. Cl.
*E01H 5/06* (2006.01)

(52) U.S. Cl.
CPC ..... *E01H 5/065* (2013.01); *E01H 5/061* (2013.01)

(58) Field of Classification Search
CPC ..... E01H 5/00; E01H 5/04; E01H 5/06; E01H 5/061; E01H 5/062; E01H 5/065; E01H 5/067
See application file for complete search history.

(56) References Cited

U.S. PATENT DOCUMENTS 2,218,512 A * 10/1940 Ball ..... E01H 5/06 172/812
4,369,847 A * 1/1983 Mizunuma ..... E02F 3/815 172/701.1
4,667,426 A * 5/1987 Howard ..... E01H 5/065 172/816
5,435,082 A * 7/1995 Frenette ..... E01H 5/06 172/668
5,638,908 A * 6/1997 Masumoto ..... B62D 55/084 172/815
5,921,326 A 7/1999 Ragule
6,442,877 B1 * 9/2002 Quenzi ..... E01H 5/065 37/281
7,584,557 B1 9/2009 Nistler
8,176,661 B2 * 5/2012 Brame ..... E01H 5/065 37/266
8,955,238 B1 * 2/2015 Castruccio ..... E01H 5/065 37/231
2003/0226289 A1 * 12/2003 Geerligs ..... E01H 5/065 37/268
2009/0249657 A1 10/2009 Freeman

* cited by examiner

*Primary Examiner* — Jamie L McGowan
(74) *Attorney, Agent, or Firm* — RG Patent Consulting, LLC; Rachel Gilboy

(57) ABSTRACT

The vehicle pulled snow scraper system is an adjustable width snow blade having a pivotally attached blade in which the forward-backward tilt of the blade is adjusted via the winch. The forward-backward tilt function also may raise and lower the bottom edge of the blade in relation to the ground surface. The invention has a two piece hitch receiver bar having two different diameters of tubing, with an impact spring between the tubes to absorb impacts when the blade catches an immovable object. The outside edges of the blade assembly extend outward to greatly increase the width of the snow plow blade as desired by the user.

19 Claims, 5 Drawing Sheets

VEHICLE PULLED SNOW SCRAPER SYSTEMS

CROSS-REFERENCE TO RELATED APPLICATION

The present application is related to and claims priority from prior provisional application Ser. No. 61/841,889, filed Jul. 1, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of snow removal blades and more specifically relates to a vehicle pulled snow scraper system.

2. Description of the Related Art

Millions of motorists in the nation's colder regions where winter, after the first couple of major snowstorms, is less a Christmas-card scene of silent, snow swept serenity than a constant and bitter battle with the elements. Snow frequently blankets the landscape and in order for an individual get in or out of their house and go anywhere, they generally have to plow, shovel, blow, snow from the driveways and walkways. Often, after just having spent a day removing the snow from walkways and driveways, homeowners awake the next day only to find that the process needs to be repeated because of new snowfall. Snow removal can be very laborious and may be dangerous to the health of the individual.

When winter comes to the North and the West, thousands of heavy-duty, industrial-grade snowplows owned and operated by big cities, small villages, counties, municipalities, states, airports, and private firms are put into action with every significant snowfall. But while the big plows keep the roads cleared, they also cover the ends of driveways with banks of snow and these must be cleared by the homeowner. In these regions, homeowners sometimes buy expensive snow blowers or similar equipment, but most residents of snow country either pay someone else to keep their driveway plowed or shovel it themselves. Motorized equipment for removing snow is expensive and not in everyone's budget. Paying for now removal also is not always in everyone's budget, especially when snow builds up very frequently. An inexpensive device that would effortlessly remove large amounts of snow in a much shorter time is needed.

Various attempts have been made to solve the above-mentioned problems such as those found in U.S. Pat. No. 5,921,326 to Edward J. Ragule, U.S. Pat. No. 7,584,557 to Timothy A. Nistler, and U.S. Publication No. 2009/0249657 to Matthew Freeman. This art is representative of snow removal blades. None of the above inventions and patents, taken either singly or in combination, is seen to describe the invention as claimed.

Ideally, a snow removal blade should provide width and length adjustment and ease of use and storage, and yet, would operate reliably and be manufactured at a modest expense. Thus, a need exists for a reliable vehicle pulled snow scraper system to avoid the above-mentioned problems.

BRIEF SUMMARY OF THE INVENTION

In view of the foregoing disadvantages inherent in the known snow removal blades art, the present invention provides a novel vehicle pulled snow scraper system. The general purpose of the present invention, which will be described subsequently in greater detail, is to provide a less expensive method for easily removing large amounts of snow.

The present invention, vehicle pulled snow scraper system, as disclosed herein, preferably comprises a snow scraper assembly having a center scraper portion with a hitch receiver bar having a stationary tube with a first end and a second end, a slide tube having a third end and a fourth end, an impact spring, a left support attacher, a right support attacher, a blade pivot stop, a left stabilizer bar, a right stabilizer bar, a left vertical brace, a right vertical brace and a main vertical brace having a top end and a bottom end, an upper horizontal receiver, a lower horizontal receiver, and a center blade portion, a left scraper portion having an left-upper adjustable bar, a left-lower adjustable bar, a left blade portion, a right scraper portion having a right-upper adjustable bar, a right-lower adjustable bar, and a right blade portion.

The snow scraper assembly comprising the center scraper portion with the hitch receiver bar, the left scraper portion, and the right scraper portion in combination are operatively functional as an adjustable angle and an adjustable width vehicle pulled snow scraper. The snow scraper assembly may be about 30 inches in height and adjust to about 13 feet in maximum length in preferred embodiments. The snow scraper assembly preferably comprises wheels so that the snow scraper assembly is able to rollably contact the ground surface with the full weight of the blade on the wheels. The blade height from the ground surface is adjusted via a winch. The center scraper portion is able to be removably coupled to a receiver tube of a trailer receiver hitch of a vehicle via the first end of the stationary tube of the hitch receiver bar. The third end of the slide tube nestably slides into the second end of the stationary tube.

The impact spring is located within the stationary tube contacting the third end of the inserted slide tube and the inner surface of the second end of the stationary tube. The second end of the hitch receiver bar may be rotatably attached to the main vertical brace and comprises a cylindrical bushing and clamp so that the hitch receiver bar is able to slide upwardly and downwardly on the main vertical brace. In a preferred embodiment, the glide bar rotatably attaches to the second end of the hitch receiver bar and the glide bar then attaches to the main vertical brace allowing the blade and blade support structure to float up and down on the glide bar with the float spring allowing upward movement of the blade and blade support structure if a bump is contacted while pushing the snow scraper assembly. The blade pivot stop is non-removably attached to a bottom side of the slide tube and limits the blade backward rotation angle.

The left support attacher is non-removably attached to the left vertical side of the hitch receiver bar and the right support attacher is non-removably attached to a right vertical side of the hitch receiver bar to provide a coupling point for the left stabilizer bar and the right stabilizer bar. The left vertical attachment end of the left stabilizer bar may comprise a cylindrical split bushing and clamp so that the left stabilizer bar is able to slide upwardly and downwardly on the left vertical brace. The left support attacher and the right support attacher may be each D-bolt loops but preferably are flat plates each having a pivot pin hole. The left stabilizer bar and the right stabilizer bar also may each comprise flat plates having pivot pin holes for pivotally coupling to the left and the right support attachers. The right vertical attachment end of the right stabilizer bar may comprise a cylindrical split bushing and clamp so that the right stabilizer bar is able to slide upwardly and slide downwardly on the right vertical brace.

The hitch receiver bar is pivotally attached to the main vertical brace, the hitch receiver bar positioned horizontally and coplanar with a longitudinal centerline of the receiver tube of the trailer receiver hitch of the vehicle. The winch of the snow scraper assembly pivotally adjusts the forward and backward tilt angle of the center scraper portion in combination with the left scraper portion and the right scraper portion, the forward angle and the backward angle. The top end of the main vertical brace perpendicularly and non-removably joins at about a midpoint of the upper horizontal receiver, and the bottom end of the main vertical brace non-removably joins at about a midpoint of the lower horizontal receiver such that the main vertical brace, the upper horizontal receiver, and the lower horizontal receiver, form a horizontal H-shape. The upper horizontal receiver preferably comprises a lifting handle. The left vertical brace and the right vertical brace are non-removably attached between the upper horizontal receiver and the lower horizontal receiver such that the left vertical brace and the right vertical brace are planar with the main vertical brace.

The left stabilizer bar is hingedly attached to the left support attacher of the hitch receiver bar and to the left vertical brace with the left stabilizer bar structured and arranged to be length-adjustable. Both the left and the right stabilizer bars preferably comprise impact springs between the left and right inner rectangular tubes and the left and right outer rectangular tubes to absorb shock if the outside corner of either side of the blade contacts an immobile object to prevent damage to the snow scraper assembly. The right stabilizer bar is hingedly attached to the right support attacher of the hitch receiver bar and to the right vertical brace, the right stabilizer bar structured and arranged such that a right-length of the right stabilizer bar is adjustable. The left stabilizer bar and the right stabilizer bar preferably comprise a left inner rectangular tube and a right inner rectangular tube respectively and a left outer rectangular tube and a right outer rectangular tube respectively. The left inner rectangular tube and the right inner rectangular tube nestably slide into the left outer rectangular tube and the right outer rectangular tube respectively, both being telescopically adjustable in length.

The left inner rectangular tube and the right inner rectangular tube of the left stabilizer bar and of the right stabilizer bar respectively each comprise a plurality of holes for adjusting length, each outer rectangular tube comprising a single locking-hole for insertion of a pull-pin through the locking-hole and through a single hole for locking the length of the left stabilizer bar and the right stabilizer bar to adjust the blade angle. The left inner rectangular tube and the right inner rectangular tube of the left stabilizer bar and of the right stabilizer bar respectively each comprise a plurality of holes, each outer rectangular tube comprising a single locking-hole for insertion of a pull-pin through the locking-hole and through a single hole of the plurality of holes in the left and right inner rectangular tubes for locking the length of the left stabilizer bar and the right stabilizer bar to adjust a blade angle. The center blade portion is removably fastened to the outer-back side of the center scraper portion.

The left-upper adjustable bar and the left-lower adjustable bar of the left scraper portion nestably slides within a left end of the upper horizontal receiver and the lower horizontal receiver respectively, the left-upper adjustable bar and the left-lower adjustable bar lockably adjustable via the plurality of through holes and lock pins. The left blade portion is removably fastened to a rearmost side of the left-upper adjustable bar and the left-lower adjustable bar. The right-upper adjustable bar and the right-lower adjustable bar of the right scraper portion nestably slide within the right end of the upper horizontal receiver and the lower horizontal receiver respectively, the right-upper adjustable bar and the right-lower adjustable bar lockably adjustable via a plurality of through orifices and adjustment pins. The right blade portion is removably fastened to a back side of the right-upper adjustable bar and the right-lower adjustable bar. The right blade portion and the left blade portion are coplanar with each other and parallel planar with the center blade portion.

The hitch receiver bar, the upper horizontal receiver, the lower horizontal receiver, the left-upper adjustable bar, the left-lower adjustable bar, the right-upper adjustable bar, and the right-lower adjustable bar each preferably comprise square tubing. The main vertical brace, the left vertical brace, and the right vertical brace preferably comprise cylindrical tubing. The snow scraper assembly is useful for attaching to a vehicle and plowing snow from the ground surface using the motor vehicle. The angle and the width of the snow scraper assembly is user-adjustable to determine the size of windrow of snow accumulated and carried via the movement of the snow scraper assembly across the snow. Any suitable movement manipulation means may be employed such as hydraulic, electric or the like.

A kit is embodied herein for the vehicle pulled snow scraper system preferably comprising at least one assembled center scraper portion with an unattached hitch receiver bar, at least one left stabilizer bar, at least one right stabilizer bar, at least one left scraper portion, at least one right scraper portion, a plurality of fasteners, at least one set of assembly instructions, and at least one set of user instructions.

In accordance with the embodiments of the present invention, a preferred method of use for the vehicle pulled snow scraper system is disclosed herein preferably comprising the steps of coupling a snow scraper assembly to a trailer receiver hitch of a vehicle, pivotally adjusting a center scraper portion in combination with a right scraper portion and a left scraper portion via the winch to lower the snow scraper assembly to rest at least one wheel on the ground surface, driving the vehicle having the attached snow scraper assembly to plow snow, disconnecting the snow scraper assembly, and storing the snow scraper assembly.

The present invention holds significant improvements and serves as a vehicle pulled snow scraper system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, vehicle pulled snow scraper system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a snow removal blade and more particularly to a vehicle pulled snow scraper system as used to reduce the amount of time for snow removal.

Generally speaking, the vehicle pulled snow scraper system is an adjustable width snow blade having a pivotally attached blade in which the forward-backward tilt of the blade is adjusted via the winch. The forward-backward tilt function also may raise and lower the bottom edge of the blade in relation to the ground surface. The invention has a two piece hitch receiver bar having two different diameters of tubing, with an impact spring inside the outer tube to absorb impacts when the blade catches an immovable object. The outside edges of the blade assembly extend outward to greatly increase the width of the snow plow blade as desired by the user.

Figure 1:
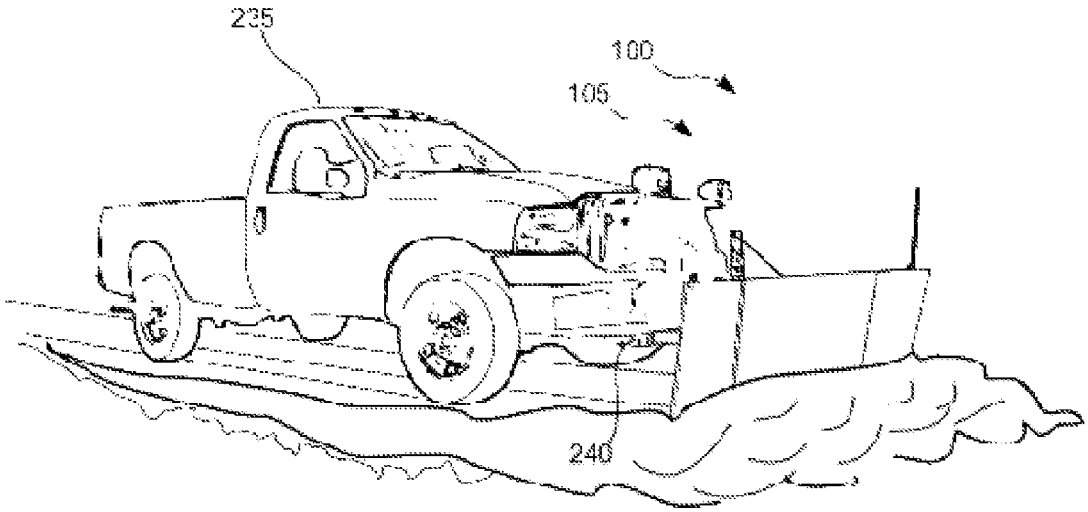
FIG. 1 shows a perspective view illustrating an in-use condition of a vehicle pulled snow scraper system according to an embodiment of the present invention.

In greater detail now, referring to the drawings by numerals of reference, there is shown in FIG. 1, a perspective view illustrating an in-use condition of vehicle pulled snow scraper system 100 according to an embodiment of the present invention.

Snow scraper assembly 105 is an apparatus designed to be manufactured inexpensively so that it is affordable for the average home owner to reduce time and labor for clearing snow from roads, driveways, and walkways. Snow scraper assembly 105 comprising center scraper portion 110 with hitch receiver bar 115, left scraper portion 270, and right scraper portion 200 in combination are operatively functional as an adjustable angle and adjustable width vehicle 235 pulled snow scraper assembly 105. Snow scraper assembly 105 may be about 30 inches in height and adjust to about 13 feet in maximum length. Snow scraper assembly 105 is useful for attaching to vehicle 235 trailer receiver hitch 240, which can be mounted on the front or the back of vehicle 235, and plowing snow from the ground surface using a motorized vehicle 235. The angle and the width of snow scraper assembly 105 is user-adjustable for determining the size of the windrow of snow generated and carried via the movement of snow scraper assembly 105 across the snow while either pushing or pulling with a motor vehicle 235, depending on whether snow scraper assembly 105 is mounted to the front or the back of vehicle 235.

Figure 2:
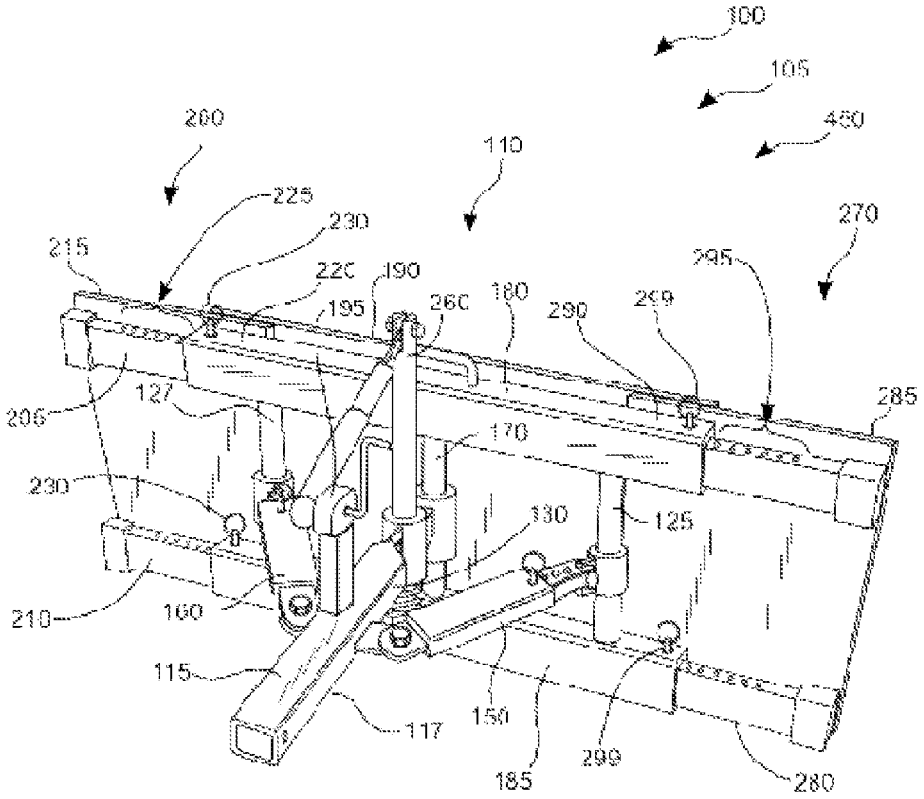
FIG. 2 is a perspective view illustrating a vehicle pulled snow scraper system according to an embodiment of the present invention of FIG. 1.

Referring now to FIG. 2, a perspective view illustrating vehicle pulled snow scraper system 100 according to an embodiment of the present invention of FIG. 1.

Vehicle pulled snow scraper system 100 preferably comprises snow scraper assembly 105 having center scraper portion 110 with hitch receiver bar 115 having stationary tube 117 with first end 119 and second end 121, slide tube 130 having third end 132 and fourth end 134, impact spring 123, left support attacher 135, right support attacher 140, blade pivot stop 145, left stabilizer bar 150, right stabilizer bar 160, left vertical brace 125, right vertical brace 127 and main vertical brace 170 having top end 172 and bottom end 174, an upper horizontal receiver 180, lower horizontal receiver 185, center blade portion 190, left scraper portion 270 having an left-upper adjustable bar 275, left-lower adjustable bar 280, and left blade portion 285, and right scraper portion 200 having right-upper adjustable bar 205, right-lower adjustable bar 210, and right blade portion 215.

Top end 172 of main vertical brace 170 perpendicularly and non-removably joins at about a midpoint of upper horizontal receiver 180, and bottom end 174 of main vertical brace 170 non-removably joins at about a midpoint of lower horizontal receiver 185 such that main vertical brace 170, upper horizontal receiver 180, and lower horizontal receiver 185, form a horizontal H-shape. Main vertical brace 170 is between upper horizontal receiver 180 and lower horizontal receiver 185. Upper horizontal receiver 180 preferably comprises lifting handle 182. Left vertical brace 125 and right vertical brace 127 are non-removably attached between upper horizontal receiver 180 and lower horizontal receiver 185 such that left vertical brace 125 and right vertical brace 127 are planar with main vertical brace 170. Center blade portion 190 is removably fastened to the outer-back side of center blade portion 190.

Left-upper adjustable bar 275 and left-lower adjustable bar 280 of left scraper portion 270 nestably slides within left end 290 of upper horizontal receiver 180 and lower horizontal receiver 185 respectively, left-upper adjustable bar 275 and left-lower adjustable bar 280 lockably adjustable via a plurality of through holes 295 and lock pin 299. Left blade portion 285 is removably fastened to rearmost side of left-upper adjustable bar 275 and left-lower adjustable bar 280. Right-upper adjustable bar 205 and right-lower adjustable bar 210 of right scraper portion 200 nestably slides within right end 220 of upper horizontal receiver 180 and lower horizontal receiver 185 respectively, right-upper adjustable bar 205 and right-lower adjustable bar 210 lockably adjustable via a plurality of through orifices 225 and adjustment pin 230. Right blade portion 215 is removably fastened to the back side of right-upper adjustable bar 205 and right-lower adjustable bar 210. Right blade portion 215 and left blade portion 285 are coplanar with each other and parallel planar with center blade portion 190.

Figure 3:
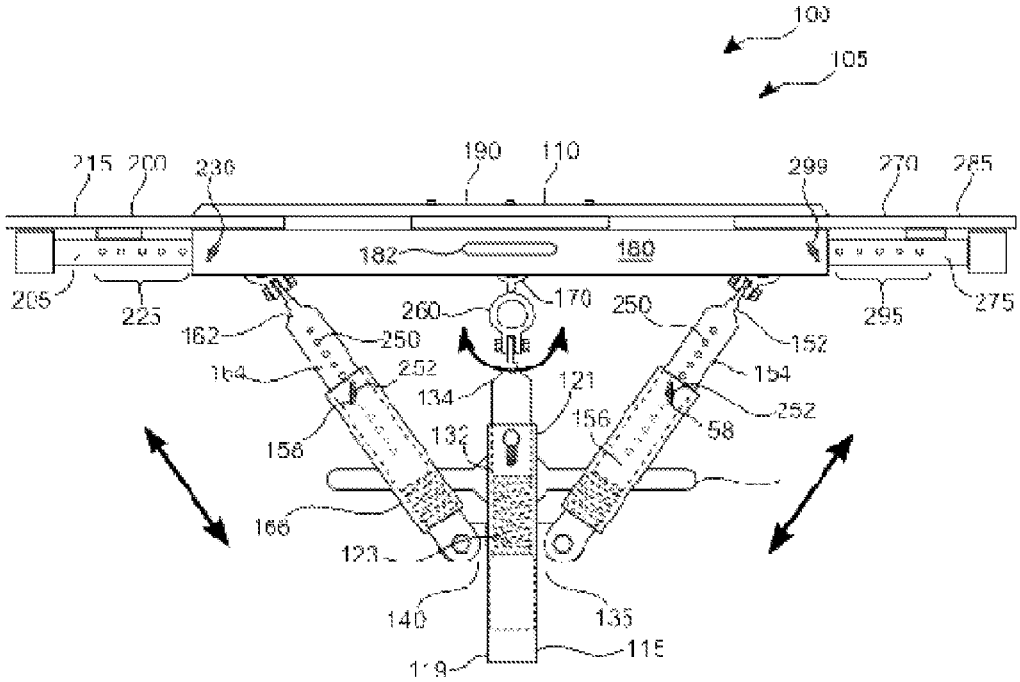
FIG. 3 is a top view illustrating the vehicle pulled snow scraper system according to an embodiment of the present invention of FIG. 1.

Referring now to FIG. 3, a top view illustrating vehicle pulled snow scraper system 100 according to an embodiment of the present invention of FIG. 1.

Left support attacher 135 is non-removably attached to the left vertical side of hitch receiver bar 115 and right support attacher 140 is non-removably attached to the right vertical side of hitch receiver bar 115 to provide a coupling point for left stabilizer bar 150 and right stabilizer bar 160. Left vertical attachment end 152 of left stabilizer bar 150 may comprise a cylindrical split bushing and clamp so that left stabilizer bar 150 is able to slide upwardly and downwardly on left vertical brace 125. Both left 150 and right stabilizer bar 160 preferably comprise springs between left 154 and right inner rectangular tubes 164 and 156 and right outer rectangular tubes 166 to absorb shock if the outside corner of either side of blade assembly 255 contacts an immobile object to prevent damage to snow scraper assembly 105. Left support attacher 135 and right support attacher 140 are preferably each flat plates having a pivot pin hole. Left stabilizer bar 150 and right stabilizer bar 160 also each comprise flat plates having a pivot pin hole for pivotally coupling to left 135 and right support attachers 140. Right vertical attachment end 162 of right stabilizer bar 160 preferably comprises a cylindrical split bushing and clamp so that right stabilizer bar 160 is able to slide upwardly and slide downwardly on right vertical brace 127. Left stabilizer bar 150 is hingedly attached to left support attacher 135 of hitch receiver bar 115 and to left vertical brace 125 with left stabilizer bar 150 structured and arranged to be length-adjustable. right stabilizer bar 160 is hingedly attached to right support attacher 140 of hitch receiver bar 115 and to right vertical brace 127 with right stabilizer bar 160 structured and arranged such that a right-length of right stabilizer bar 160 is length adjustable.

Left inner rectangular tube 154 and right inner rectangular tube 164 of left stabilizer bar 150 and of right stabilizer bar 160 respectively each comprise a plurality of holes 250 for adjusting length, left outer rectangular tube 156 and right outer rectangular tube 166 comprising a single locking-hole 252 for insertion of a pull-pin 158 through locking-hole and through a single hole for locking the length of left stabilizer bar 150 and right stabilizer bar 160 to adjust center scraper portion 110 angle. Left inner rectangular tube 154 and right inner rectangular tube 164 of left stabilizer bar 150 and of right stabilizer bar 160 respectively each comprise plurality of holes 250 for length adjustment, left 156 and right outer rectangular tube 166 comprising a single locking-hole for insertion of pull-pin 158 through locking-hole and through a single hole of the plurality of holes 250 for locking the length of left stabilizer bar 150 and right stabilizer bar 160 to adjust a snow scraper assembly 105 angle. Hitch receiver bar 115, upper horizontal receiver 180, lower horizontal receiver 185, left-upper adjustable bar 275, left-lower adjustable bar 280, right-upper adjustable bar 205, and right-lower adjustable bar 210 each preferably comprise square tubing. Main vertical brace 170, left vertical brace 125, and right vertical brace 127 preferably comprise cylindrical tubing.

Figure 4:
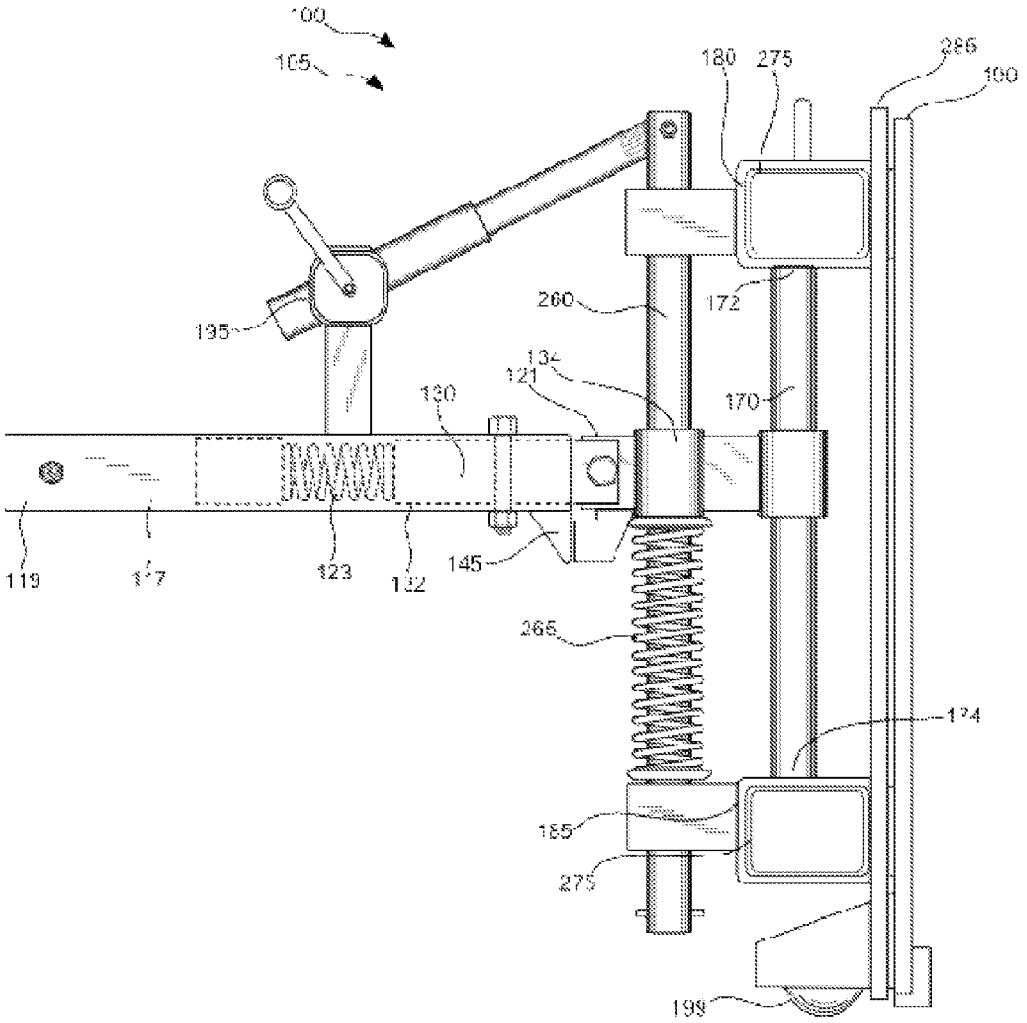
FIG. 4 is a side view illustrating the vehicle pulled snow scraper system according to an embodiment of the present invention of FIG. 1.

Referring now to FIG. 4, showing a side view illustrating vehicle pulled snow scraper system 100 according to an embodiment of the present invention of FIG. 1.

Snow scraper assembly 105 preferably comprises wheels 199 so that snow scraper assembly 105 is able to rollably contact the ground surface with the full weight of snow scraper assembly 105 on wheels 199. Center blade portion 190 height from the ground surface is preferably adjusted via winch 195. Center scraper portion 110 is able to be removably coupled to a receiver tube of trailer receiver hitch 240 of vehicle 235 via first end 119 of stationary tube 117 of hitch receiver bar 115. Third end 132 of slide tube 130 nestably slides into second end 121 of stationary tube 117. Impact spring 123 is located within stationary tube 117 contacting third end 132 of the inserted slide tube 130 and inner surface of second end 121 of stationary tube 117. In a preferred embodiment, glide bar 260 rotatably attaches to second end 121 of hitch receiver bar 115 and glide bar 260 then attaches to main vertical brace 170 allowing blade assembly 255 and blade support structure 245 to float up and down on glide bar 260 with float spring 265 allowing upward movement of blade assembly 255 and blade support structure 245 if a bump is contacted while pushing snow scraper assembly 105. Second end 121 of hitch receiver bar 115 is rotatably attached to main vertical brace 170 and may comprise a cylindrical bushing and clamp, or other suitable connection device, so that hitch receiver bar 115 is able to slide upwardly and downwardly on glide bar 260.

Blade pivot stop 145 is non-removably attached to the bottom side of slide tube 130 and limits center scraper portion 110 backward rotation angle which can raise and lower center blade portion 190 bottom edge in relation to the ground surface. Hitch receiver bar 115 is pivotally attached to main vertical brace 170, hitch receiver bar 115 positioned horizontally and coplanar with a longitudinal centerline of a receiver tube of trailer receiver hitch 240 of vehicle 235. Winch 195 of snow scraper assembly 105 pivotally adjusts the forward and backward tilt angle of center scraper portion 110 in combination with left scraper portion 270 and right scraper portion 200, the forward angle and the backward angle. Left stabilizer bar 150 and right stabilizer bar 160 preferably comprise left inner rectangular tube 154 and right inner rectangular tube 164 respectively and left outer rectangular tube 156 and right outer rectangular tube 166 respectively. Left inner rectangular tube 154 and right inner rectangular tube 164 nestably slides into left outer rectangular tube 156 and right outer rectangular tube 166 respectively, both being telescopically adjustable in length.

Vehicle pulled snow scraper system 100 may be sold as kit 450 comprising the following parts: at least one assembled center scraper portion 110 with an unattached hitch receiver bar 115; at least one left stabilizer bar 150; at least one right stabilizer bar 160; at least one left scraper portion 270; at least one right scraper portion 200; a plurality of fasteners; at least one set of assembly instructions; and at least one set of user instructions. The kit has instructions such that functional relationships are detailed in relation to the structure of the invention (such that the invention can be used, maintained, or the like in a preferred manner). Vehicle pulled snow scraper system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different blade combinations, parts may be sold separately, etc., may be sufficient.

Figure 5:
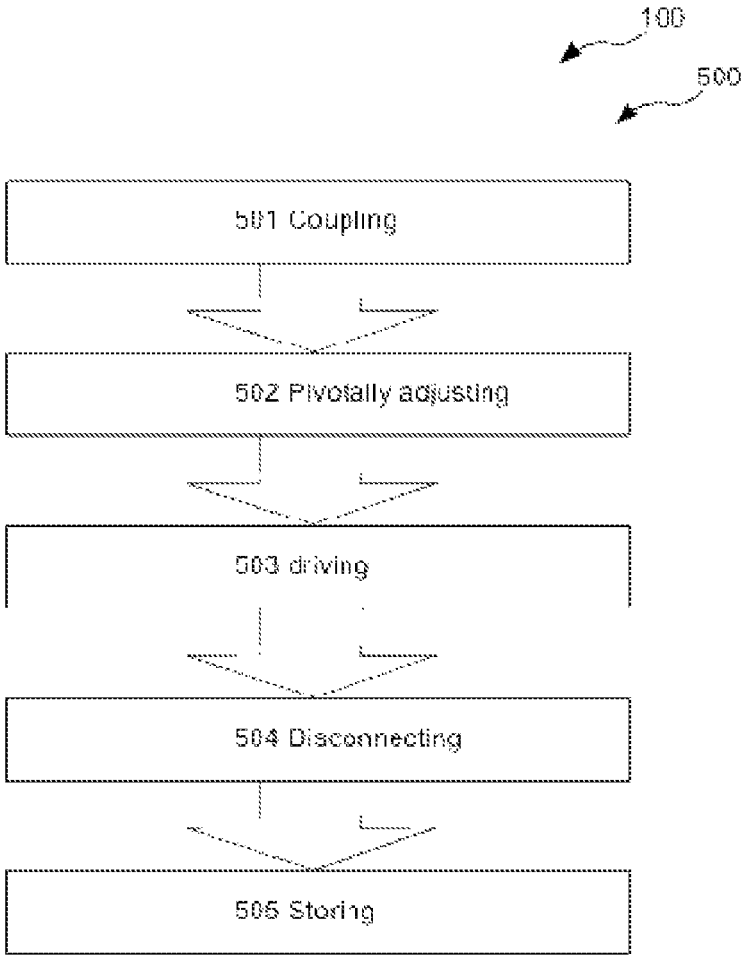
FIG. 5 is a flowchart illustrating a method of use for the vehicle pulled snow scraper system according to an embodiment of the present invention of FIGS. 1-4.

Referring now to FIG. 5, showing method of use 500 for vehicle pulled snow scraper system 100.

A method of using (method of use 500) vehicle pulled snow scraper system 100 may comprise the steps of step one 501 coupling snow scraper assembly 105 to trailer receiver hitch 240 of vehicle 235; step two 502 pivotally adjusting center scraper portion 110 in combination with right scraper portion 200 and left scraper portion 270 via winch 195 to lower snow scraper assembly 105 to rest at least one wheels 199 on the ground surface; step three 503 driving vehicle 235 having the attached snow scraper assembly 105 to plow snow; step four 504 disconnecting snow scraper assembly 105; and step five 505 storing snow scraper assembly 105.

It should be noted that step 502 is an optional step and may not be implemented in all cases. Optional steps of method 500 are illustrated using dotted lines in FIG. 5 so as to distinguish them from the other steps of method 500. Those with ordinary skill in the art will now appreciate that upon reading this specification and by their understanding the art of snow plows as described herein, methods of using a vehicle pulled snow scraper systems 100 will be understood by those knowledgeable in such art.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A vehicle pulled snow scraper system comprising:

a snow scraper assembly comprising;

a center scraper portion having;

a hitch receiver bar comprising;

a stationary tube having a first end and a second end; and a slide tube having a third end and a fourth end;

an impact spring;

a left support attacher;

a right support attacher; and a blade pivot stop;

a left stabilizer bar;

a right stabilizer bar;

a left vertical brace;

a right vertical brace; and a main vertical brace having a top end and a bottom end;

an upper horizontal receiver;

a lower horizontal receiver; and a center blade portion;

a left scraper portion having;

an left-upper adjustable bar;

a left-lower adjustable bar; and a left blade portion;

a right scraper portion having;

a right-upper adjustable bar;

a right-lower adjustable bar; and a right blade portion;

wherein said snow scraper assembly comprising said center scraper portion with said hitch receiver bar, said left scraper portion, and said right scraper portion in combination are operatively functional as an adjustable angle and an adjustable width vehicle pulled snow scraper;

wherein said center scraper portion is removably coupled to a receiver tube of a trailer receiver hitch of a vehicle via said first end of said stationary tube of said hitch receiver bar;

wherein said third end of said slide tube nestably slides into said second end of said stationary tube, said impact spring located within said stationary tube contacting said third end of said slide tube and an inner surface of said second end of said stationary tube;

wherein said blade pivot stop is non-removably attached to a bottom side of said slide tube, said blade pivot stop limiting a blade backward rotation angle;

wherein said left support attacher is non-removably attached to a left vertical side of said hitch receiver bar and said right support attacher is non-removably attached to a right vertical side of said hitch receiver bar to provide a coupling point for said left stabilizer bar and said right stabilizer bar;

wherein said hitch receiver bar is pivotally attached to said main vertical brace, said hitch receiver bar positioned horizontally and coplanar with a longitudinal centerline of said receiver tube of said trailer receiver hitch of said vehicle;

wherein said top end of said main vertical brace perpendicularly and non-removably joins about a midpoint of said upper horizontal receiver, and said bottom end of said main vertical brace non-removably joins about a midpoint of said lower horizontal receiver such that said main vertical brace, said upper horizontal receiver, and said lower horizontal receiver form a horizontal H-shape;

wherein said left vertical brace and said right vertical brace are non-removably attached to and between said upper horizontal receiver and said lower horizontal receiver such that said left vertical brace and said right vertical brace are planar with said main vertical brace;

wherein said left stabilizer bar is hingedly attached to said left support attacher of said hitch receiver bar and to said left vertical brace, said left stabilizer bar structured and arranged such that a length of said left stabilizer bar is adjustable;

wherein said right stabilizer bar is hingedly attached to said right support attacher of said hitch receiver bar and to said right vertical brace, said right stabilizer bar structured and arranged such that a right-length of said right stabilizer bar is adjustable;

wherein said center blade portion is removably fastened to an outer-back side of said center scraper portion;

wherein said left-upper adjustable bar and said left-lower adjustable bar of said left scraper portion nestably slide within a left end of said upper horizontal receiver and said lower horizontal receiver respectively, said left-upper adjustable bar and said left-lower adjustable bar lockably adjustable via a plurality of through holes and a lock pin;

wherein said left blade portion is removably fastened to a rearmost side of said left-upper adjustable bar and said left-lower adjustable bar;

wherein said right-upper adjustable bar and said right-lower adjustable bar of said right scraper portion nestably slide within a right end of said upper horizontal receiver and said lower horizontal receiver respectively, said right-upper adjustable bar and said right-lower adjustable bar lockably adjustable via a plurality of through orifices and adjustment pins;

wherein said right blade portion is removably fastened to a back side of said right-upper adjustable bar and said right-lower adjustable bar; and wherein said snow scraper assembly is useful for plowing snow from a ground surface using a motor vehicle, said angle and said width of said snow scraper assembly user-adjustable to determine a weight of a windrow of said snow accumulated via a movement of said snow scraper assembly across said snow.

2. The vehicle pulled snow scraper system of claim 1 wherein said right blade portion and said left blade portion are coplanar with each other and parallel planar with said center blade portion.

3. The vehicle pulled snow scraper system of claim 1 wherein said left stabilizer bar and said right stabilizer bar comprise a left inner rectangular tube and a right inner rectangular tube respectively and a left outer rectangular tube and a right outer rectangular tube respectively, said left inner rectangular tube and said right inner rectangular tube nestably slides into said left outer rectangular tube and said right outer rectangular tube respectively, both being telescopically adjustable in length.

4. The vehicle pulled snow scraper system of claim 3 wherein said left inner rectangular tube and said right inner rectangular tube of said left stabilizer bar and of said right stabilizer bar respectively each comprise a plurality of holes, each said outer rectangular tube comprising a single locking-hole for insertion of a pull-pin through said locking-hole and through a single said hole for locking said length of said left stabilizer bar and said right stabilizer bar to adjust a blade angle.

5. The vehicle pulled snow scraper system of claim 1 wherein said second end of said hitch receiver bar is rotatably attached to said main vertical brace.

6. The vehicle pulled snow scraper system of claim 1 wherein said upper horizontal receiver further comprises a lifting handle.

7. The vehicle pulled snow scraper system of claim 1 wherein said snow scraper assembly is about 30 inches in height.

8. The vehicle pulled snow scraper system of claim 7 wherein said snow scraper assembly adjusts to about 13 feet in length.

9. The vehicle pulled snow scraper system of claim 5 wherein said second end of said hitch receiver bar is rotatably attached to a glide bar, said glide bar attached to said main vertical brace.

10. The vehicle pulled snow scraper system of claim 5 wherein said glide bar comprises a float spring such that said snow scraper assembly is able to glide upward and alternately downward using a spring dampening pressure.

11. The vehicle pulled snow scraper system of claim 8 wherein said snow scraper assembly comprises wheels such that said snow scraper assembly is able to rollably contact said ground surface.

12. The vehicle pulled snow scraper system of claim 1 wherein said second end of said hitch receiver bar comprises a cylindrical bushing and clamp such that said hitch receiver bar is able to slide upwardly and slide downwardly on said main vertical brace.

13. The vehicle pulled snow scraper system of claim 1 wherein a left vertical attachment end of said left stabilizer bar comprises a cylindrical split bushing and clamp such that said left stabilizer bar is able to slide upwardly and slide downwardly on said left vertical brace.

14. The vehicle pulled snow scraper system of claim 1 wherein a right vertical attachment end of said right stabilizer bar comprises a cylindrical split bushing and clamp such that said right stabilizer bar is able to slide upwardly and slide downwardly on said right vertical brace.

15. The vehicle pulled snow scraper system of claim 8 wherein said snow scraper assembly further comprises a winch for pivotally adjusting a forward angle and alternately a backward angle of said center scraper portion in combination with said left scraper portion and said right scraper portion, said forward angle and said backward angle determining a height of said snow scraper assembly in relation to said ground surface.

16. The vehicle pulled snow scraper system of claim 1 wherein said hitch receiver bar, said upper horizontal receiver, said lower horizontal receiver, said left-upper adjustable bar, said left-lower adjustable bar, said right-upper adjustable bar, and said right-lower adjustable bar each comprise square tubing.

17. The vehicle pulled snow scraper system of claim 1 wherein said main vertical brace, said left vertical brace, and said right vertical brace comprise cylindrical tubing.

18. The vehicle pulled snow scraper system of claim 17 further comprising a kit including:

at least one assembled said center scraper portion with an unattached said hitch receiver bar;
at least one said left stabilizer bar;
at least one said right stabilizer bar;
at least one said left scraper portion;
at least one said right scraper portion;
a plurality of fasteners;
at least one set of assembly instructions; and
at least one set of user instructions.

19. A vehicle pulled snow scraper system comprising:

a snow scraper assembly comprising;
- a center scraper portion having;
  - a hitch receiver bar comprising;
    - a stationary tube having a first end and a second end; and
    - a slide tube having a third end and a fourth end;
    - an impact spring;
    - a left support attacher;
    - a right support attacher; and
    - a blade pivot stop;
  - a left stabilizer bar;
  - a right stabilizer bar;
  - a left vertical brace;
  - a right vertical brace; and
  - a main vertical brace having a top end and a bottom end;
  - an upper horizontal receiver;
  - a lower horizontal receiver; and
  - a center blade portion;
- a left scraper portion having;
  - an left-upper adjustable bar;
  - a left-lower adjustable bar; and
  - a left blade portion;
- a right scraper portion having;
  - a right-upper adjustable bar;
  - a right-lower adjustable bar; and
  - a right blade portion;

wherein said snow scraper assembly comprising said center scraper portion with said hitch receiver bar, said left scraper portion, and said right scraper portion in combination are operatively functional as an adjustable angle and an adjustable width vehicle pulled snow scraper;

wherein said snow scraper assembly is about 30 inches in height;

wherein said snow scraper assembly adjusts to about 13 feet in length;

wherein said snow scraper assembly comprises wheels such that said snow scraper assembly is able to rollably contact said ground surface;

wherein said center scraper portion is removably coupled to a receiver tube of a trailer receiver hitch of a vehicle via said first end of said stationary tube of said hitch receiver bar;

wherein said third end of said slide tube nestably slides into said second end of said stationary tube, said impact spring located within said stationary tube contacting said third end of said slide tube and an inner surface of said second end of said stationary tube;

wherein said second end of said hitch receiver bar is rotatably attached to said main vertical brace;

wherein said second end of said hitch receiver bar comprises a cylindrical bushing and clamp such that said hitch receiver bar is able to slide upwardly and slide downwardly on said main vertical brace;

wherein said blade pivot stop is non-removably attached to a bottom side of said slide tube, said blade pivot stop limiting a blade backward rotation angle;

wherein said left support attacher is non-removably attached to a left vertical side of said hitch receiver bar and said right support attacher is non-removably attached to a right vertical side of said hitch receiver bar to provide a coupling point for said left stabilizer bar and said right stabilizer bar;

wherein a left vertical attachment end of said left stabilizer bar comprises a cylindrical split bushing and clamp such that said left stabilizer bar is able to slide upwardly and slide downwardly on said left vertical brace;

wherein said left support attacher and said right support attacher each comprise D-bolt loops;

wherein said left stabilizer bar and said right stabilizer bar each comprise D-bolt connections for a pivotal attachment to said left support attacher and said right support attacher of said hitch receiver bar;

wherein a right vertical attachment end of said right stabilizer bar comprises a cylindrical split bushing and clamp such that said right stabilizer bar is able to slide upwardly and slide downwardly on said right vertical brace;

wherein said hitch receiver bar is pivotally attached to said main vertical brace, said hitch receiver bar positioned horizontally and coplanar with a longitudinal centerline of said receiver tube of said trailer receiver hitch of said vehicle;

wherein said snow scraper assembly further comprises a winch for pivotally adjusting a forward angle and alternately a backward angle of said center scraper portion in combination with said left scraper portion and said right scraper portion, said forward angle and said backward angle determining a height of said snow scraper assembly in relation to said ground surface;

wherein said top end of said main vertical brace perpendicularly and non-removably joins about a midpoint of said upper horizontal receiver, and said bottom end of said main vertical brace non-removably joins about a midpoint of said lower horizontal receiver such that said main vertical brace, said upper horizontal receiver, and said lower horizontal receiver form a horizontal H-shape;

wherein said upper horizontal receiver further comprises a lifting handle;

wherein said left vertical brace and said right vertical brace are non-removably attached to and between said upper horizontal receiver and said lower horizontal receiver such that said left vertical brace and said right vertical brace are planar with said main vertical brace;

wherein said left stabilizer bar is hingedly attached to said left support attacher of said hitch receiver bar and to said left vertical brace, said left stabilizer bar structured and arranged such that a length of said left stabilizer bar is adjustable;

wherein said right stabilizer bar is hingedly attached to said right support attacher of said hitch receiver bar and to said right vertical brace, said right stabilizer bar structured and arranged such that a right-length of said right stabilizer bar is adjustable;

wherein said left stabilizer bar and said right stabilizer bar comprise a left inner rectangular tube and a right inner rectangular tube respectively and a left outer rectangular tube and a right outer rectangular tube respectively, said left inner rectangular tube and said right inner rectangular tube nestably slides into said left outer rectangular tube and said right outer rectangular tube respectively, both being telescopically adjustable in length;

wherein said left inner rectangular tube and said right inner rectangular tube of said left stabilizer bar and of said right stabilizer bar respectively each comprise a plurality of holes, each said outer rectangular tube comprising a single locking-hole for insertion of a pull-pin through said locking-hole and through a single said hole for locking said length of said left stabilizer bar and said right stabilizer bar to adjust a blade angle;

wherein said left inner rectangular tube and said right inner rectangular tube of said left stabilizer bar and of said right stabilizer bar respectively each comprise a plurality of holes, each said outer rectangular tube comprising a single locking-hole for insertion of a pull-pin through said locking-hole and through a single said hole for locking said length of said left stabilizer bar and said right stabilizer bar to adjust a blade angle;

wherein said center blade portion is removably fastened to an outer-back side of said center scraper portion;

wherein said left-upper adjustable bar and said left-lower adjustable bar of said left scraper portion nestably slide within a left end of said upper horizontal receiver and said lower horizontal receiver respectively, said left-upper adjustable bar and said left-lower adjustable bar lockably adjustable via a plurality of through holes and lock pins;

wherein said left blade portion is removably fastened to a rearmost side of said left-upper adjustable bar and said left-lower adjustable bar;

wherein said right-upper adjustable bar and said right-lower adjustable bar of said right scraper portion nestably slide within a right end of said upper horizontal receiver and said lower horizontal receiver respectively, said right-upper adjustable bar and said right-lower adjustable bar lockably adjustable via a plurality of through orifices and adjustment pins;

wherein said right blade portion is removably fastened to a back side of said right-upper adjustable bar and said right-lower adjustable bar;

wherein said right blade portion and said left blade portion are coplanar with each other and parallel planar with said center blade portion;

wherein said hitch receiver bar, said upper horizontal receiver, said lower horizontal receiver, said left-upper adjustable bar, said left-lower adjustable bar, said right-upper adjustable bar, and said right-lower adjustable bar each comprise square tubing;

wherein said main vertical brace, said left vertical brace, and said right vertical brace comprise cylindrical tubing; and wherein said snow scraper assembly is useful for plowing snow from a ground surface using a motor vehicle, said angle and said width of said snow scraper assembly user-adjustable to determine a weight of a windrow of said snow accumulated via a movement of said snow scraper assembly across said snow.

* * * * *